US005180281A

United States Patent [19]

Burge et al.

[11] Patent Number: 5,180,281

[45] Date of Patent: Jan. 19, 1993

[54] CASE TYING MEANS FOR GAS TURBINE ENGINE

[75] Inventors: Joseph C. Burge, Palm Beach Gardens; Richard J. Tiernan, Jr., Hobe Sound, both of Fla.

[73] Assignee: United Technologies Corporation, Hartford, Conn.

[21] Appl. No.: 830,518

[22] Filed: Feb. 3, 1992

Related U.S. Application Data

[63] Continuation of Ser. No. 581,231, Sep. 12, 1990, abandoned.

[51] Int. Cl.[5] ..... F01D 9/04

[52] U.S. Cl. ..... 415/209.2

[58] Field of Search ..... 415/115, 116, 209.1, 415/209.2, 209.3, 173.1, 173.3; 29/888.02

[56] References Cited

U.S. PATENT DOCUMENTS

| | | | |
|---|---|---|---|
| 2,623,728 | 12/1952 | Feilden et al. | 415/209.1 |
| 2,834,537 | 5/1958 | Neary | 415/209.2 |
| 2,848,156 | 8/1958 | Oppenheimer | 415/209.3 |
| 2,863,634 | 12/1958 | Chamberlin et al. | 415/173.1 |
| 2,928,586 | 3/1960 | Hart | 415/209.1 |
| 3,024,968 | 3/1962 | Payne et al. | 415/209.2 |
| 4,529,355 | 7/1985 | Wilkinson | 415/173.3 |
| 4,762,462 | 8/1988 | Lardellier | 415/177 |

*Primary Examiner*—John T. Kwon
*Attorney, Agent, or Firm*—Norman Friedland

[57] ABSTRACT

The segmented inner case supporting the stator vanes of the compressor is tied to an axially split outer case of a gas turbine engine by utilizing a segmented ring-like element forming a rail with bosses at either end and intermediate the ends and having a relatively thin resilient body between bosses capable of flexing in response to thermal loads. Bolts extending through the outer case are threaded into the bosses. This arrangement facilitates the assembly and disassembly of the compressor section.

3 Claims, 2 Drawing Sheets

CASE TYING MEANS FOR GAS TURBINE ENGINE

The invention was made under a U.S. Government contract and the Government has rights herein.

This is a continuation of pending application Ser. No. 07/581,231, filed on Sep. 12, 1990, now abandoned.

CROSS REFERENCE

The subject matter of this application is related to the subject matter of the following commonly assigned patent applications: U.S. application Ser. No. 581,223 entitled "Fastener For Multi-Stage Compressor"; U.S. application Ser. No. 581,224 entitled "Fastener Mounting For Multi-Stage Compressor"; U.S. application Ser. No. 581,230 entitled "Compressor Bleed"; U.S. application Ser. No. 581,229 entitled "Segmented Stator Vane Seal"; U.S. application Ser. No. 581,228 entitled "Backbone Support Structure For Compressor"; U.S. application Ser. No. 581,227 entitled "Compressor Case Construction With Backbone"; U.S. application Ser. No. 581,219 entitled "Compressor Case Construction"; U.S. application Ser. No. 581,240 entitled "Compressor Case Attachment Means"; U.S. application Ser. No. 581,220 entitled "Compressor Case With Controlled Thermal Environment"; all of the above filed on even date herewith.

TECHNICAL FIELD

This invention relates to gas turbine engines and more particularly to the construction of the compressor section.

BACKGROUND ART

As is well known, the compressor case of a gas turbine engine powering aircraft is subjected to severe pressure and temperature loadings throughout the engine operating envelope and care must be taken to assure that the components remain concentric maintaining relatively close running clearances so as to avoid inadvertent rubs. Inasmuch as the engine case is thin relative to the rotor and stator components in the compressor section, it responds more rapidly to temperature changes than do other components. This is particularly true during periods of transient engine performance. Typical of these transients are throttle chops, throttle bursts, and the like. Obviously it is customary to provide sufficient clearances during these transients to assure that the rotating parts do not interfere with the stationary parts.

The problem becomes even more aggravated when the engine case is fabricated in two halves (split case) which is necessitated for certain maintenance and construction reasons. Typically, the halves are joined at flanges by a series of bolts and the flanges compared to the remaining portion of the circumference of the case are relatively thick and hence do not respond to thermal and pressure changes as quickly as the thinner portion of the case. The consequence of this type of construction is that the case has a tendency to grow eccentrically or out of round.

In order to achieve the roundness and clearance control of the stationary an rotating components it was necessary to incorporate a mechanism that would tie the outer case to the segmented stator components. It also is important to assure that rubbing does not occur, particularly where severe rubbing could permanently damage the blades and/or rotor/stator during surge. The mechanism that is utilized must be capable of withstanding enormous load, yet be insensitive to fatigue. Flexibility is required in the configuration while maintaining fixed hardware. The problem is more aggravated since the engine is designed to avoid surge and surge may be non-existing so the part used to solve the problem only has utility during a circumstance that may not occur. Thus, it is abundantly important that it doesn't present a maintenance problem, i.e. require early removal because of fatigue. Furthermore, it shouldn't be unduly heavy, since weight would impact overall engine performance.

We have found that we can obviate the problems noted above, or at least alleviate the same, by providing a relatively thin arcuate shaped rail trapped in hooks extending from the segmented stator ring that supports the stator vanes in the compressor for tying the outer axially split case. This permits the use of the split case and concomitantly facilitated the assembly of the compressor section.

STATEMENT OF THE INVENTION

An object of this invention is to provide improved fastener means for tying the inner case of the compressor of a gas turbine engine to the outer axially split case to obtain a round concentric flow path.

A feature of this invention is to thermally isolate the casing outer wall from the engine's gas path so that the high heat transfer rates of this gas stream has a reduced influence thereon. This permits the proper selection of materials so to match the thermal response and achieve a close clearance between the stator and rotor parts.

The foregoing and other features and advantages of the present invention will become more apparent from the following description and accompanying drawings.

BEST MODE FOR CARRYING OUT THE INVENTION

Figure 1:
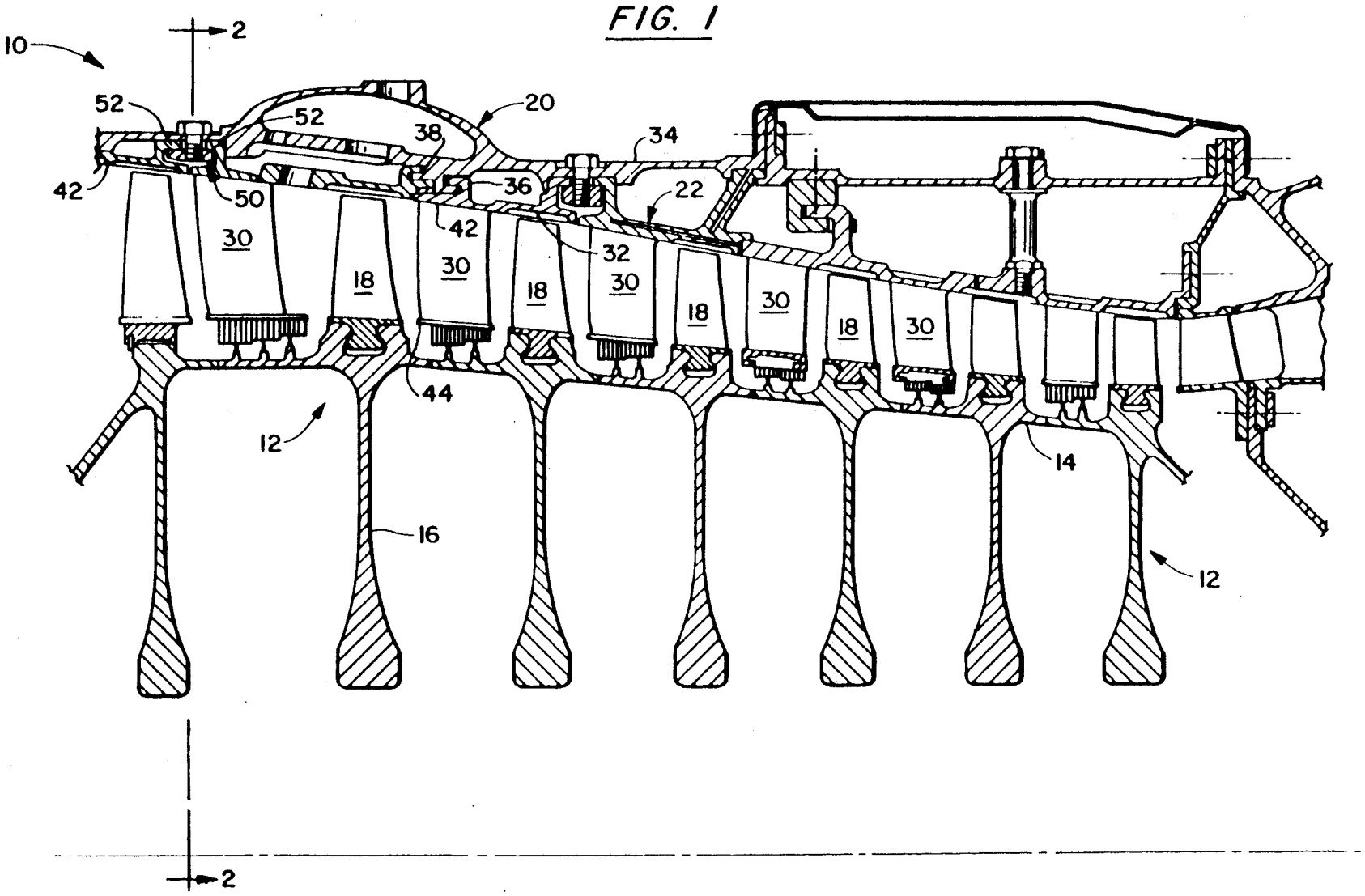
FIG. 1 is a partial view partly in section and partly in elevation of a multi-stage axial flow compressor for a gas turbine engine.
Figure 2:
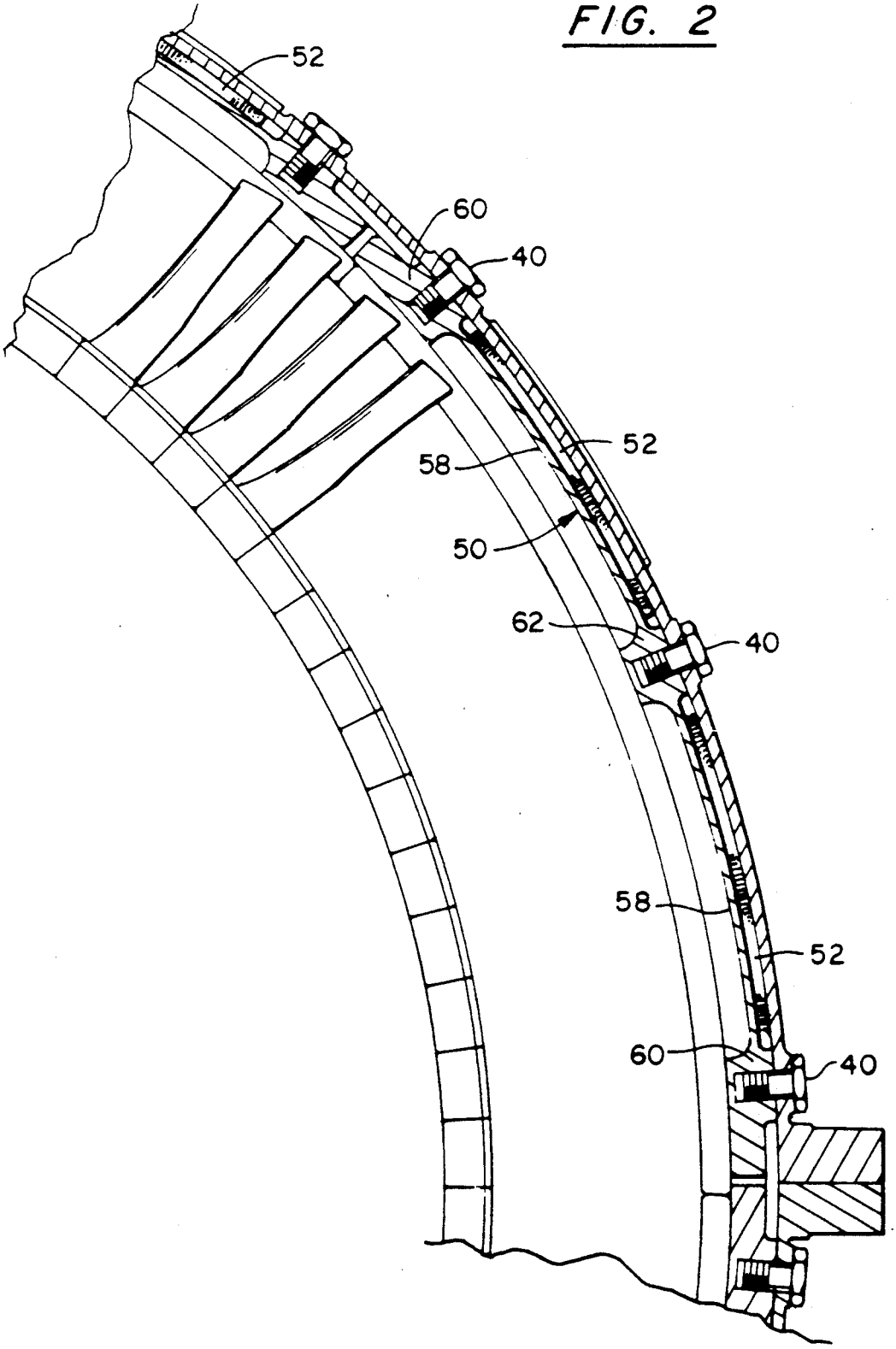
FIG. 2 is a partial sectional view partly in schematic taken along lines 2—2 of FIG. 1 showing one of several segments of the components making up the inner case.

To best understand this invention reference is made to FIGS. 1 and 2 showing part of a multi-stage compressor for a gas turbine engine of the type for powering aircraft. For more details of a gas turbine engine the F100 family of engines manufactured by Pratt & Whitney, a division of United Technologies Corporation, the assignee of this patent application, is incorporated herein by reference. Suffice it to say that in the preferred embodiment the engine on which this invention is being utilized is a fan-jet axial flow compressor multi-spool type. As noted in FIG. 1 the compressor section generally indicated by reference numeral 10 is comprised of a plurality of compressor rotors 12 retained in drum rotor 14, where each rotor includes a disk 16 supporting a plurality of circumferentially spaced compressor blades 18. The rotors 12 are suitably supported in an outer engine case 20 and an inner case 22.

In this configuration a portion of the outer case 20 is fabricated in two axial circumferential halves and the other portion is fabricated in a full hoop generally cylindrically shaped case. In FIG. 1 the first four lower pressure stages as viewed from the left hand side are housed in the split case and the last three stages are housed in the full case.

Inasmuch as this invention pertains to the fore section (split case, of the compressor, for the sake of simplicity and convenience only the portion of the compressor dealing with the split case will be discussed hereinbelow. The inner case 22 which comprises the augmented stator vanes 30 and outer air seal 32 are supported in the split case 34 by the hooks 36 fitted into groove 38 of the split case 34 and the rails 50 disposed between compressor stages as will be described hereinbelow.

The stator vane 30 comprises a plurality of cast arcuate shaped segments each consisting of an outer shroud 42 and an inner shroud 44 and a plurality of circumferentially spaced vanes 30. The arcuate shaped segments are mounted end-to-end to define a ring and the boundary for the gas path.

Inasmuch as the rails for attaching the axially split case 34 to the stator are generally identical for the sake of simplicity and convenience only the rails at the upstream location will be described. It being understood that the principles described for the rail construction are applicable to the other rails. As noted in FIGS. 1 and 2 the rail 50 fits into an annular groove formed by the radially extending hooks 52 formed on the outer shrouds 42 of adjacent stator vane segments. The rail 50 is formed in arcuate shaped segments 58 mounted end-to-end to define a ring.

Each segment includes a boss 60 located at either end and at least another boss 62 disposed intermediate the ends. A plurality of bolts 40 threaded to each boss tie the outer split case 34 to the stator vanes.

In accordance with this invention each rail segment is made from a relatively thin section extending between bosses. This configuration of the rail 50 allows the rails to flex and are sufficiently resilient to accommodate the thermal and mechanical stresses imposed thereon, thereby alleviating these loads from the split outer case which would otherwise have a tendency to ovalize, i.e., come out of round.

It is apparent from the foregoing that the stator vanes are assembled in side-by-side axial arrangement with the rails; that the rails are then bolted and tightened to the prescribed torque level; and that the split case is then bolted together at its respective flanges (not shown); which simplifies the heretofore method of stacking the stages in the one piece outer case.

Although the invention has been shown and described with respect to detailed embodiments thereof, it will be understood by those skilled in the art that various changes in form and detail thereof may be made without departing from the spirit and scope of the claimed invention.

We claim:

1. For a gas turbine engine having a compressor section including an axially split outer engine case rotably supporting a drum rotor having axially spaced rows of circumferentially mounted compressor blades, comprising a plurality of axially spaced stator vanes, each stator vane including an outer shroud and a concentrically disposed inner shroud, defining therewith a gas path for the engine's working medium, a plurality of circumferentially spaced vanes disposed between said outer shroud and said inner shroud in said gas path and being disposed between adjacent rows of said compressor blades, hook-like elements extending radially outward from adjacent outer shrouds and spaced from said gas path, a segmented ring-like element defining a rail engaging each of said hook-like elements of adjacent outer shrouds spaced radially from said gas path and said outer engine case, each of said segments of said rail having a first boss and a second boss mounted at either end of said segment and a third boss mounted between said first boss and said second boss, and bolt means extending through openings in said outer engine case threadably engaging said first boss, said second boss and said third boss, whereby said bolt means and said rail support said stator vanes to said outer engine case and said ring-like element being sufficiently flexible in response to engine thermal condition to have virtually no effect on said engine outer case.

2. For a gas turbine engine as claimed in claim 1 wherein said axially spaced stator vanes includes a plurality of stator vane segments, each segment including an inner shroud portion and an outer shroud portion and a plurality of circumferentially spaced vanes disposed between said inner shroud portion and said outer shroud portion, and said stator vane segments being disposed end-to-end relative to each other to define a full ring.

3. For a gas turbine engine as claimed in claim 2 wherein said rails include a relatively thin section connecting each of said first boss, said second boss and said third boss, and said relatively thin section being sufficiently resilient as to deform when subjected to a given heat load.

* * * * *